US006837842B1

(12) United States Patent
Dellden

(10) Patent No.: US 6,837,842 B1
(45) Date of Patent: Jan. 4, 2005

(54) METHOD AND DEVICE FOR INDICATING AN UNDESIRED OPERATION CONDITION OF A CENTRIFUGAL SEPARATOR

(75) Inventor: Lars Håkan Dellden, Stockholm (SE)

(73) Assignee: Alfa Laval AB, Tumba (SE)

( * ) Notice: Subject to any disclaimer, the term of this patent is extended or adjusted under 35 U.S.C. 154(b) by 0 days.

(21) Appl. No.: 10/030,373

(22) PCT Filed: Mar. 3, 2000

(86) PCT No.: PCT/SE00/00424

§ 371 (c)(1),
(2), (4) Date: May 20, 2002

(87) PCT Pub. No.: WO00/53331

PCT Pub. Date: Sep. 14, 2000

(30) Foreign Application Priority Data

Mar. 8, 1999 (SE) ..... 9900815

(51) Int. Cl.[7] ..... B04B 11/00

(52) U.S. Cl. ..... 494/2; 494/5; 494/10; 494/37

(58) Field of Search ..... 494/1–6, 10–11, 494/37, 68–70; 210/138, 143, 781

(56) References Cited

U.S. PATENT DOCUMENTS

| | | | | | |
|---|---|---|---|---|---|
| 3,167,509 | A | * | 1/1965 | Steinacker | 494/3 |
| 3,396,910 | A | * | 8/1968 | Steinacker | 494/3 |
| 3,445,061 | A | * | 5/1969 | Nilson | 494/3 |
| 3,580,493 | A | * | 5/1971 | Jonsson | 494/2 |
| 3,593,915 | A | * | 7/1971 | Steinacker | 494/3 |
| 3,637,134 | A | * | 1/1972 | Nelson | 494/2 |
| 3,642,196 | A | * | 2/1972 | Nilsson | 494/2 |
| 3,938,734 | A | * | 2/1976 | Wilke | 494/11 |
| 3,976,242 | A | * | 8/1976 | Hemfort | 494/3 |
| 4,151,950 | A | * | 5/1979 | Gunnewig | 494/2 |
| 4,206,871 | A | | 6/1980 | Nilsson | |
| 4,305,817 | A | * | 12/1981 | Kohlstette | 210/104 |
| 4,410,318 | A | | 10/1983 | Björk et al. | |
| 4,820,256 | A | * | 4/1989 | Nordstrom | 494/3 |
| 4,840,612 | A | * | 6/1989 | Pallmar | 494/2 |
| 5,800,330 | A | * | 9/1998 | Modeer | 494/2 |
| 6,080,098 | A | * | 6/2000 | Borgstrom et al. | 494/27 |
| 6,358,193 | B1 | * | 3/2002 | Nyberg | 494/2 |

FOREIGN PATENT DOCUMENTS

| | | | |
|---|---|---|---|
| DE | 4242526 C1 | * | 2/1994 |
| JP | 10-272383 | | 10/1998 |
| SE | 409 662 | | 9/1979 |

* cited by examiner

*Primary Examiner*—Charles E. Cooley
(74) *Attorney, Agent, or Firm*—McCormick, Paulding & Huber LLP

(57) ABSTRACT

An indication device indicates an undesired operation condition of a centrifugal separator and comprises an inlet valve situated in a supply conduit to the separator, and an outlet valve situated in an outlet conduit from the separator. During normal operation of the separator the valves are adjusted in open normal valve positions for passing normal flows through the supply and outlet conduits. A control unit is adapted to activate a signal generator to generate an error signal in response to a pressure sensor if the pressure sensor during a predetermined period of time during operation of the separator senses a course of pressure change in the outlet conduit different from an expected normal course of pressure change, when the inlet and outlet valves during predetermined period of time are adjusted in valve positions which at least substantially decreases the flows in the supply and outlet conduits from the normal flows.

13 Claims, 1 Drawing Sheet

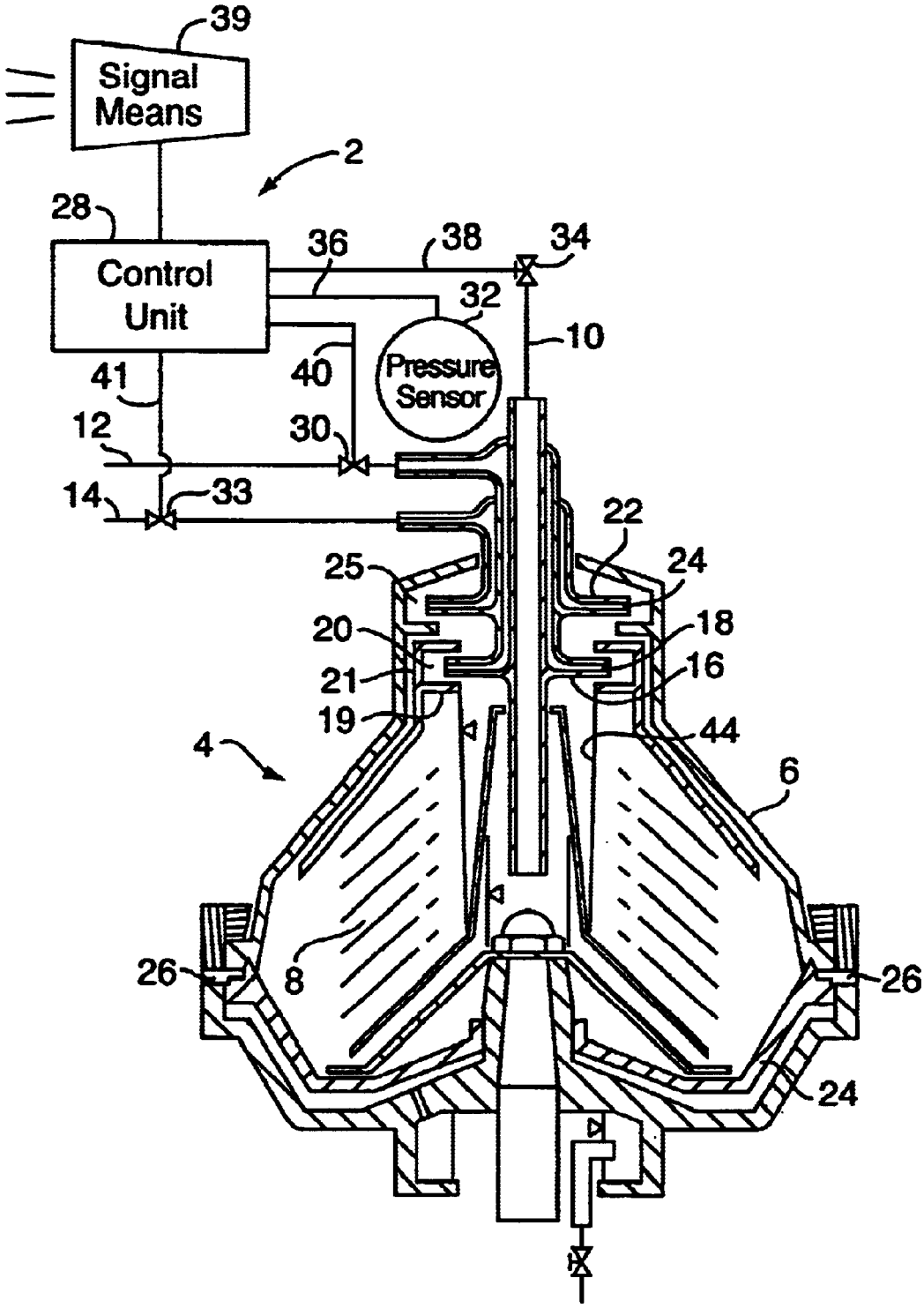
FIGURE

METHOD AND DEVICE FOR INDICATING AN UNDESIRED OPERATION CONDITION OF A CENTRIFUGAL SEPARATOR

CROSS REFERENCE TO RELATED APPLICATIONS

This application is entitled to the benefit of, and incorporates by reference, essential subject matter disclosed in International Application No. PCT/SE00/00424 filed on Mar. 3, 2000 and Swedish Patent Application No. 9900815-3 filed on Mar. 8, 1999.

FIELD OF THE INVENTION

The present invention relates to a method and device for indicating an undesired operating condition of a centrifugal separator comprising a centrifugal rotor forming a separation chamber, a supply conduit for supplying a liquid mixture to be separated to the separation chamber, the liquid mixture containing at least two components, at least two outlets for discharging a separated component each out of the separation chamber, one outlet being arranged to discharge a separated liquid phase comprising one of the components, and an outlet conduit, the interior of which communicates with said one outlet.

BACKGROUND OF THE INVENTION

An undesired operating condition of a centrifugal separator of the kind stated above can arise from different causes and is often difficult to discover. This can lead to operating an impaired centrifugal separator for an extended period of time. One cause of an undesired operating condition is leakage through valves which were thought to be completely closed. For example, the centrifugal separator can be provided with a sludge discharge means, which intermittently discharges accumulated separated sludge together with liquid from the separation chamber with the aid of an axially moveable slide valve. Between the discharge movements the slide valve has to seal in order to cause the formation of a boundary layer between separated liquid phases at an intended radial level in the separation chamber. With respect to the function of the centrifugal separator it is important that the formed boundary layer is at the intended radial level. If liquid escapes out of the separation chamber via the slide valve the boundary layer is formed at a radial level which is situated outside the intended radial level, and results in a less than desirable separation. However, the centrifugal rotor is surrounded by a stationary protective cover making it impossible to visually identify a leaking slide valve.

SE-B-409 662 suggests a device for indicating leakage in a centrifugal separator that intermittently discharges sludge. The device comprises a vibration sensing piezoelectric crystal placed on the protective cover so that leaking liquid flow can contact the crystal. The concept is that the piezoelectric crystal is hit by droplets thrown from the rotating centrifugal rotor and generates a signal used to activate an alarm device.

For certain applications, for example the cleaning of oil from minor amounts of water and sludge, the centrifugal separator may be provided with three outlets for discharging three components from the separation chamber. In general, these outlets are a light phase outlet for a light component such as oil, a heavy phase outlet for a heavy component such as water and an outlet for a sludge component. If the amount of water separated is a small fraction of the amount of oil separated, the heavy phase or sludge outlet is provided with an intermittently opening valve for discharging the accumulated heavy phase (water) in batches. For the same reasons as described above in connection with the centrifugal separator with an intermittently opening slide valve for discharging sludge the heavy phase outlet valve has to be seal between openings in order to prevent the centrifugal separator from being operated at an undesired condition, or to prevent the loss of valuable product.

For other applications, for example the cleaning of liquid mixtures from large amounts of sludge, the centrifugal separator usually has a discharge means that continuously discharges separated sludge from the separation chamber by a plurality of nozzles. The nozzles are distributed around the centrifugal rotor at the radially outermost portion thereof. In this case an undesired operating condition of the centrifugal separator arises if the flow of sludge through the nozzles increases due to wear thereof, or if the sludge flow decreases due to clogging of one or more nozzles. Wear and clogging of the nozzles results in an impaired separation result.

An object of the present invention is to provide a reliable method of indicating an undesired operating condition in a centrifugal separator.

SUMMARY OF THE INVENTION

This object is obtained by a method which is characterised by: operating the centrifugal separator, sensing a normal operation pressure in the outlet conduit, when a normal flow of the liquid mixture occurs in the supply conduit and a normal flow of the liquid phase occurs in the outlet conduit, substantially decreasing the flow of the liquid mixture through the supply conduit from the normal flow of the liquid mixture during a predetermined period of time, substantially decreasing the flow of the liquid phase through the outlet conduit from the normal flow of the liquid phase during the same predetermined period of time, sensing the course of the pressure change in the outlet conduit from the normal operation pressure during the predetermined period of time, and generating an error signal in response to the sensed course of pressure change when this deviates from an expected normal course of pressure change. Preferably predetermined period of time comprises one or a few seconds.

When the centrifugal separator is new and existing valves and liquid nozzles are new the expected normal course of pressure change can easily be determined by a empirical test. Alternatively, the course of pressure change can be determined by theoretical calculations.

Depending on the constitution of the centrifugal separator the expected course of pressure change can be determined for different conditions. For example, the flow of the liquid phase through the outlet conduit and/or the flow of the liquid mixture through the supply conduit or both flows may be shut off during the predetermined period of time.

When the second separated component constitutes sludge the second outlet of the centrifugal separator may be formed by a sludge discharge means for intermittent discharge of the sludge. In addition, the centrifugal rotor forms an outlet chamber for said one component and a paring disc forming said one outlet is arranged in the outlet chamber. In this case the error signal is suitably generated if the pressure in the outlet conduit decreases to a predetermined low pressure during the predetermined period of time. The predetermined low pressure is chosen such that if the sludge discharge means functions as expected and does not leak between discharge occasions, the pressure in the outlet conduit should not have time to decrease to the low pressure during the predetermined period of time.

The predetermined period of time, during which the course of pressure change in the outlet conduit is sensed, suitably begins as soon as the centrifugal separator has reverted to an expected normal operation condition after a sludge discharge occasion.

Alternatively, the second outlet of the centrifugal separator may be formed by a sludge discharge means for continuously discharging the sludge. In this case, the error signal is suitably generated if the pressure in the outlet conduit decreases during the predetermined period of time at a rate that differs from an expected normal pressure decreasing rate. To prevent the pressure in the outlet conduit from decreasing too rapidly to the ambient pressure during the predetermined period of time the flow through the supply conduit should not be completely closed, but rather be reduced to a known flow, preferably equal to the total flow through the nozzles during normal operation conditions with the nozzles working correctly.

A further object of the present invention is to provide a simple reliable device for indicating an undesired operation condition of a centrifugal separator of the kind stated initially.

This further object is obtained by a device which is characterised by an inlet valve situated in the supply conduit and adjustable between open and closed conditions, an outlet valve situated in the outlet conduit and adjustable between open and closed conditions, the valves being adjustable in open normal valve positions to allow normal flows to pass through the supply and outlet conduits during normal operation of the centrifugal separator. A pressure sensor is provided for sensing the pressure in the outlet conduit upstream of the outlet valve. Signal means are included for generating an error signal, and a control unit is provided for activating the signal means to generate the error signal in response to the pressure sensor detecting, during a predetermined period of time during operation of the centrifugal separator, a pressure change in the outlet conduit differing from an expected normal pressure change, when the inlet and outlet valves during the predetermined period of time are adjusted in valve positions which at least substantially decrease the flows in the supply and outlet conduits from the normal flows therein. For example, the outlet valve may be closed, or both the inlet valve and the outlet valve may be closed.

When the second one of the separated components is constituted of sludge, the second outlet of the centrifugal separator may include a sludge discharge means for intermittent discharge of the sludge. The centrifugal rotor further forms an outlet chamber for one component and a paring disc forming the outlet is arranged in the outlet chamber. In this case, the control unit preferably activates the signal means to generate the error signal in response to the pressure sensor detecting a pressure in the outlet conduit below a predetermined pressure, which is lower than a normal operation pressure therein.

Alternatively, the second outlet of the centrifugal separator may be formed by a sludge discharge means for continuous discharge of the sludge. In this case the control unit preferably activates the signal means to generate the error signal in response to the pressure sensor detecting, during the predetermined period of time, a pressure in the outlet conduit which decreases at a rate differing from an expected normal pressure gradient.

The control unit controls the inlet valve for adjusting the valve position thereof, activates the signal means to generate the error signal, and locks the inlet valve in a closed valve position in response to the pressure sensor detecting the pressure change in the outlet conduit differing, to an unacceptably large extent, from the expected normal pressure change. The expression "a pressure change in the outlet conduit differing to an unacceptably large extent" is intended to mean a pressure change indicating an operating condition that does not give a satisfactory separation result or causes product losses. In this case the centrifugal separator should be taken out of operation for service or repair.

The control unit may also control the outlet valve for adjusting the valve position thereof.

Instead of adjusting the normal flows and reduced flows with the aid of the valves, of course the flows may also be adjusted in a different way for instance by controlling a supply pump.

BRIEF DESCRIPTION OF THE DRAWINGS

The invention is described in more detail in the following with reference to the sole FIGURE, which shows a cross-section through an intermittently sludge discharging centrifugal separator provided with a device according to an embodiment of the invention.

DETAILED DESCRIPTION OF THE PREFERRED EMBODIMENT

The FIGURE shows a device 2 according to the invention for indicating an undesired operating condition of a centrifugal separator 4, which in the illustrated embodiment is intended for separating sludge and water containing oil into a light first component comprising oil, a heavy second component comprising water and a heavy third component comprising sludge. The centrifugal separator comprises a centrifugal rotor 6 forming a separation chamber 8, a supply conduit 10 for supplying oil to be separated to the separation chamber 8, a first outlet conduit 12 for discharging separated oil, and a second outlet conduit 14 for discharging separated water. A stationary oil paring disc 16 forms an outlet 18 communicating with the interior of the first outlet conduit 12 and extending radially into an annular oil outlet chamber 20, which is formed by a U-shaped wall portion 19 attached to the centrifugal rotor 6. From the bottom of the oil paring disc 16 a hole 21 extends through the wall portion 19. A stationary water paring disc 22 forms an outlet 24 communicating with the interior of the second outlet conduit 14 and extending radially into an annular water outlet chamber 25, which is formed by the centrifugal rotor 6. An axially moveable slide valve 24 is adapted to intermittently open a passage to a number of sludge outlets 26 in the radially outermost portion of the centrifugal rotor 6.

The indication device 2 comprises a control unit 28 having electronic equipment for signal processing, a first outlet valve 30 in the first outlet conduit 12, a pressure sensor 32 for sensing the pressure in the first outlet conduit 12 upstream of the first outlet valve 30, a second outlet valve 33 in the second outlet conduit 14, and an inlet valve 34 in the supply conduit 10. The pressure sensor 32 is connected to the control unit via a signal line 36. The inlet valve 34, first outlet valve 30 and first outlet valve 33 are connected to the control unit 28 via control lines 38, 40 and 41, respectively. A signal means 39 for generating an alarm signal is connected to the control means 28 via a signal line 42.

During normal operation of the centrifugal separator the liquid mixture consisting of sludge and water containing oil is pumped via the supply conduit 10 through the inlet valve 34, which by the control unit 28 is adjusted in an open normal valve position, for instance completely open valve position, and further into the separation chamber 8. In the separation chamber 8 the oil in the liquid mixture is separated radially inwardly and flows to the oil outlet chamber 20, from which the oil flows further through the outlet 18 of the oil paring disc 16 and via the first outlet conduit 12 through the first outlet valve 30, which by the control unit is adjusted in an open normal valve position, for instance a completely open valve position. The hole 21 from the outlet chamber 20 may have a significant flow capacity.

The water in the liquid mixture separates in the separation chamber 8 radially outwardly and flows to the water outlet chamber 25, from which the water flows further through the outlet 24 of the water paring disc 22 and via the second outlet conduit 14 through the second outlet valve 33 likewise adjusted in an open normal valve position, for instance a completely open valve position. If the water content of the liquid mixture is low the water accumulated in the water paring chamber 25 may be discharged in batches by intermittent opening of the second outlet valve 33.

Sludge in the liquid mixture separates radially outwardly in the separation chamber 8 and accumulates in the radially outermost part of the separation chamber 8. The slide valve 24 is intermittently opened for short moments, normally in intervals of one or more hours, whereby the accumulated sludge and remaining liquid in the separation chamber 8 are thrown out through the sludge outlets 26.

During normal operation the control unit 28 senses a normal operating pressure in the first outlet conduit 12 with the aid of the pressure sensor 32. As soon as the centrifugal separator 4 has reverted to an expected normal operating condition after a sludge discharge event the indication device 2 according to the invention checks the operating condition of the centrifugal separator 4 in the following manner. The control unit 28 closes almost simultaneously the inlet valve 34 and first outlet valve 30 and when necessary also the second outlet valve 33 during a predetermined period of time, which comprises one or a few seconds. This may result in the pressure in the outlet conduit 12 temporarily increasing over the operating pressure. If for instance the slide valve 24 is not sealing the free liquid surface 44 of the separation chamber 8 will move radially outwardly and the oil in the oil outlet chamber 20 will be drained through the hole 21, which results in the pressure sensor 32 detecting a pressure reduction. This pressure reduction takes place faster with greater leakage past the slide valve 24.

If the pressure in the first oil outlet conduit 12 has time to decrease during the predetermined period of time to a predetermined low pressure, which indicates a relatively large leakage, the control unit 28 activates the signal means 39 to generate an alarm signal. However, the centrifugal separator 4 may be in operation for some additional time with a satisfactory result. If the pressure in the oil outlet conduit 12 has time to decrease during the predetermined period of time to yet a lower pressure, which indicates unacceptably large leakage, the control unit 28 activates the signal means 39 to generate an alarm signal and keeps the inlet valve 34 closed even after the lapse of the predetermined period of time. In this case the centrifugal separator 4 is taken out of operation for service or repair.

Instead of sensing the pressure after a certain predetermined period of time, it would be possible within the scope of the present invention to sense the course of pressure change continuously or at a plurality of time points during a predetermined period of time and to compare the sensed course of pressure change with a course of pressure change during normal operation conditions.

What is claimed is:

1. A method of indicating an undesired operation condition of a centrifugal separator, which includes a centrifugal rotor forming a separation chamber, a supply conduit for supplying a liquid mixture to be separated to the separation chamber, the liquid mixture containing at least two components, at least two outlets for discharging separated component, respectively, out of the separation chamber, one outlet of the two outlets for discharging a separated liquid phase comprising one of the components, and a first outlet conduit, the interior of which communicates with said one outlet, said method comprising the steps of operating the centrifugal separator, sensing a normal operating pressure in the first outlet conduit, when a normal flow of the liquid mixture prevails in the supply conduit and a normal flow of the liquid phase prevails in the first outlet conduit, at least substantially decreasing the flow of the liquid mixture through the supply conduit from the normal flow of the liquid mixture during a predetermined period of time, at least substantially decreasing the flow of the liquid phase through the first outlet conduit from the normal flow of the liquid phase during the same predetermined period of time, sensing the course of the pressure change in the outlet conduit from the normal operating pressure during the predetermined period of time, and generating an error signal in response to the sensed course of pressure change when this deviates from an expected normal course of pressure change.

2. A method according to claim 1, wherein the flow of the liquid phase through the first outlet conduit is prevented during the predetermined period of time.

3. A method according to claim 1, wherein the flow of the liquid mixture through the supply conduit is prevented during the predetermined period of time.

4. A method according to claim 1, wherein the second of the separated components constitutes sludge, a second outlet of the centrifugal separator is formed by a sludge discharge means for intermittent discharge of the sludge, the centrifugal rotor forms an outlet chamber for said one component, and a paring disc is arranged in the outlet chamber and forms said one outlet, and wherein the error signal is generated if the pressure in the first outlet conduit decreases to a predetermined low pressure during the predetermined period of time.

5. A method according to claim 4, wherein the predetermined period of time, during which the pressure change in the first outlet conduit is sensed, begins as soon as the centrifugal separator has reverted to an expected normal operation condition after a sludge discharging event.

6. A method according to claim 1, wherein the second of the separated components is constituted by sludge and the second outlet of the centrifugal separator is formed by a sludge discharge means for continuous discharge of the sludge, and wherein the error signal is generated if the pressure in the first outlet conduit decreases at a rate differing from an expected normal pressure decreasing rate during the predetermined period of time.

7. A device for indicating an undesired operating condition of a centrifugal separator comprising: a centrifugal rotor forming a separation chamber, a supply conduit for supplying a liquid mixture to be separated to the separation chamber, the liquid mixture containing at least two components, at least two outlets for discharging separated components, respectively, out of the separation chamber, one outlet of the two outlets for discharging a separated liquid phase comprising one of the two components, and a first outlet conduit, the interior which communicates with said one outlet, an inlet valve situated in the supply conduit and adjustable between open and closed positions, a first outlet valve situated in the first outlet conduit and adjustable between open and closed positions, the valves being adjustable in at least partly open normal valve positions for passing normal flows through the supply and outlet conduits during normal operation of the centrifugal separator, a pressure sensor for detecting the pressure in the first outlet conduit upstream the outlet valve, a signal means for generating an error signal, and means for activating the signal means to generate the error signal in response to the pressure sensor detecting during a predetermined period of time of the operation of the centrifugal separator a course of pressure change in the outlet conduit differing from an expected normal course of pressure change, when the inlet and outlet valves during the predetermined period of time are adjusted in valve positions which at least substantially decreases the flows in the supply and outlet conduits from the normal flows therein.

8. A device according to claim 7, wherein during the predetermined period of time the activating means is adapted to activate the signal means to generate the error signal in response to the pressure sensor detecting a course of pressure change in the first outlet conduit differing from an expected normal course of pressure change, when the first outlet valve is closed and the first inlet valve is adjusted in a valve position which at least substantially decreases the flow in the supply conduit from the normal flow therein.

9. A device according to claim 7, wherein during the predetermined period of time the activating means is adapted to activate the signal means to generate the error signal in response to the pressure sensor detecting a course of pressure change in the first outlet conduit differing from an expected normal course of pressure change, when the inlet and outlet valves are closed.

10. A device according to claim 7, wherein the second of the separated components is constituted by sludge, the second outlet of the centrifugal separator is formed by a sludge discharge means for intermittent discharge of the sludge, the centrifugal rotor forms an outlet chamber for said one component, and a paring disc is arranged in the outlet chamber and forms said one outlet, and during the predetermined period of time the activating means is adapted to activate the signal means to generate the error signal in response to the pressure sensor detecting a pressure in the first outlet conduit which is below a predetermined pressure, which is lower than a normal operation pressure in the first outlet conduit.

11. A device according to claim 7, in which the second of the separated components is constituted by sludge and the second outlet of the centrifugal separator is formed by a sludge discharge means for continuous discharge of the sludge, and during the predetermined period of time the activating means is adapted to activate the signal means to generate the error signal in response to the pressure sensor detecting a pressure in the first outlet conduit which decreases at a rate differing from an expected normal pressure decreasing rate.

12. A device according to claim 7, wherein the activating means controls the inlet valve for adjusting the valve position thereof, and that during the predetermined period of time the activating means is adapted to activate the signal means to generate the error signal and lock the inlet valve in a closed valve position in response to the pressure sensor detecting a course of pressure change in the first outlet conduit differing to an unacceptably large extent from the expected normal course of pressure change.

13. A device according to claim 7, wherein the activating means controls the outlet valve for adjusting the valve position thereof.

* * * * *